US006334350B1

(12) United States Patent
Shin et al.

(10) Patent No.: US 6,334,350 B1
(45) Date of Patent: Jan. 1, 2002

(54) AUTOMATIC MACHINE FOR THE FORMATION OF SHIP'S CURVED HULL-PIECES

(76) Inventors: Jong Gye Shin, Samchang Golden Village 105-108, Banpo-4 Dong 586-3, Seocho-ku, Seoul 137-044 (KR); Won Don Kim, Samho Garden Apt., 2-1204 Woo-2 Dong 1104-1, Haewoondae-ku, Pusan 612-022 (KR)

( * ) Notice: Subject to any disclaimer, the term of this patent is extended or adjusted under 35 U.S.C. 154(b) by 0 days.

(21) Appl. No.: 09/623,230

(22) PCT Filed: Mar. 2, 1999

(86) PCT No.: PCT/KR99/00092

§ 371 Date: Aug. 30, 2000

§ 102(e) Date: Aug. 30, 2000

(87) PCT Pub. No.: WO99/44765

PCT Pub. Date: Sep. 10, 1999

(30) Foreign Application Priority Data

Mar. 5, 1998 (KR) ..... 98-7333

(51) Int. Cl.[7] ..... B21D 37/16

(52) U.S. Cl. ..... 72/342.5; 72/17.3; 72/18.7; 72/19.6; 72/31.1; 72/342.2; 72/342.6

(58) Field of Search ..... 72/17.3, 18.2, 72/18.7, 19.6, 19.7, 31.1, 31.11, 342.1, 342.2, 342.5, 342.6, 342.94

(56) References Cited

U.S. PATENT DOCUMENTS 3,770,256 A * 11/1973 Godin et al. ..... 72/342.5
5,737,957 A * 4/1998 Gray ..... 72/342.94
6,002,118 A * 12/1999 Kawano et al. ..... 72/342.1

FOREIGN PATENT DOCUMENTS

| | | | | |
|---|---|---|---|---|
| CA | 1238262 | * | 6/1988 | 72/342.1 |
| JP | 59-189017 | * | 10/1984 | 72/342.1 |
| JP | 60-199528 | * | 10/1985 | 72/342.5 |
| JP | 9-258202 | * | 9/1997 | 72/342.1 |
| SU | 724239 | * | 3/1980 | 72/342.1 |

* cited by examiner

*Primary Examiner*—Ed Tolan
(74) *Attorney, Agent, or Firm*—Antonelli, Terry, Stout & Kraus, LLP

(57) ABSTRACT

This invention relates to an automatic machine to form curved plates (100) of ship's hull-pieces in a shipbuilding process. This automatic machine has the following devices, ajig table (10) to support steel plates, a heating device (21) including a torch to heat one side of steel plates up to the required temperature (about 800 C.), a cooling device to cool down the heated plates by spraying out coolant from several nozzles (32), a measuring device (41) to measure the formed plates set up beside the cooling device. The measuring gauge (41) transmits data to the control system through A/D converter (42). A driving device includes a transverse guide rail (51), a longitudinal guide rail (52), motors, chains and belts, all of which enable the torch, cooler and measuring gauge to move in accordance with commands of the control system.

12 Claims, 3 Drawing Sheets

AUTOMATIC MACHINE FOR THE FORMATION OF SHIP'S CURVED HULL-PIECES

This application is a 35 USC 371 of PCT/KR99/00092, filed Mar. 2, 1999.

TECHNICAL FIELD

This invention relates to an automatic machine to form curved plates of ship's hull-pieces in shipbuilding process, more particularly, to an automatic machine can form curved plates by heating any one side of the plates locally with heating apparatuses.

BACKGROUND ART

In the ship production process, a ship's hull is fabricated by forming the pieces out of the plates with any thickness in accordance with design data and welding these pieces.

In general, there are two ways to form the curved hull-pieces: hot forming method and cold forming method. Hot forming method of those methods has been used for the completing work of curved plates, the second, or longitudinal forming process of doubly curved plates, and the remove of undesired deformation by welding as it can easily cause residual thermal plastic deformation by heating.

Since plates are heated on along the straight line in the hot forming method, the method is called "line heating process." This work has been manually performed only by some experts. One worker heats the plate toward the given direction with a heating torch and a cooler or one heats the plate with a torch and another cools down the plate along the heated line with a cooler.

Also, in such former work the workers has used templates, the measuring gauges which are previously made of wood in order to make sure how much the plates are formed. If the templates perfectly contact the formed plate at specific locations, they admit that the plate is formed as desired.

So far, as previously mentioned all formation process of the curved plates has been manually performed only by some workers. It means that the formation process has been performed only with experiences of the line-heating experts, not with the information which is derived from the accurate and theoretical backgrounds. That has decreased the productivity in the formation of the curved plates and the fabrication has been made inaccurately. But the formation of the curved plates requires the high accuracy in the shipbuilding process.

In conclusion, such former process for the formation of the ship's hull-pieces, in which heating, cooling, and measuring is manually performed by some experts has difficulties in precise fabrication and decreases the efficiency of ship production. And there has not been any automatic machine to complete hot forming process of ship's hull-pieces.

DISCLOSURE OF THE INVENTION

In order to improve such problems, our aim in this invention is to provide an automatic machine for the formation of ship's curved hull-pieces to enable that process by heating, cooling and measuring plates to be systemized, to be standardized, and to be automated according to the prefabricated information instead of experiences of skillful workers.

Through the automation of such hot forming works, the productivity in the formation of the curved plates and its accuracy can be improved, this invention is about such automatic machine.

To accomplish the previous subjects, this invention has feature that an automatic machine is designed to implement systematic and accurate forming process by equipping the following devices.

- Jig table to be equipped with many jigs to support any shaped steel plates and load-constraining apparatus to prevent the undesired deformation by uniformly sharing the load among the edges of the plates
- Heating device including a torch to locally heat one side of steel plates up to the required temperature (about 800° C.), setting up over a jig table and moving before and behind, and left and right
- Cooling device to immediately cool down the heated plates by spraying out coolant from several nozzles, which is set up around a torch and moves along the same path as the torch
- Measuring device to measure the formed plates and other information with a gauge to be set up beside the cooling device, and to transmit the data to the control system through A/D converter to convert analogue signals sent by the gauge to digital signals
- Driving device to include a transverse guide rail, a longitudinal guide rail, motors, chains, belts, etc., all of which enable the torch, the cooler, and the measuring gauge to move in accordance with commands of a control system
- Control device to consist of main controllers and a display device, where main controllers systematically handle the operations of this machine during forming and the operating state and results are monitored through the display device.

According to one aspect of this invention, there is provided an automatic machine for ship's curved hull-pieces includes jig table to support steel plates; heating device including a torch to heat one side of steel plates up to the required temperature (about 800° C.), setting up over a jig table and moving before and behind, and left and right; cooling device to cool down the heated plates by spraying out coolant from several nozzles, which is set up around a torch and moves along the same path as the torch; measuring device to measure the formed plates and other information with a gauge to be set up beside the cooling device, and to transmit the data to the control system through A/D converter to convert analogue signals sent by the gauge to digital signals; driving device to include a transverse guide rail, a longitudinal guide rail, motors, chains, belts, all of which enable the torch, the cooler, and the measuring gauge to move in accordance with commands of a control system; and control device to consist of main controllers and a display device, where main controllers handle the operations of this machine during forming and the operating state and results are monitored through the display device.

According to another aspect of this invention, the heating device can be one of gas-oxygen flaming, laser, electric induction heating, and electronic beam heating.

According to another aspect of this invention, there is provided the automatic machine for ship's curved hull-pieces having the cooling device whose cooling method is one of water cooling and air cooling.

According to another aspect of this invention, the heating device by the gas flaming consists of gas-supplying tanks, oxygen-supplying tanks, pressure controllers which control the quantity of gas and oxygen, a heating apparatus, or a torch, and an igniter.

According to another aspect of this invention, the jig table consists of the load-constraining device and several jigs to have the function of load-constraining device to uniformly distribute the load at edges of the plate in order to prevent the undesired deformation and the function of jigs to support the bottom of the plates by stretching and shrinking and to be equipped with the contact sensor on its end.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

According to the appended figures below, we intend to definitely explain an automatic machine in our invention.

Figure 1:
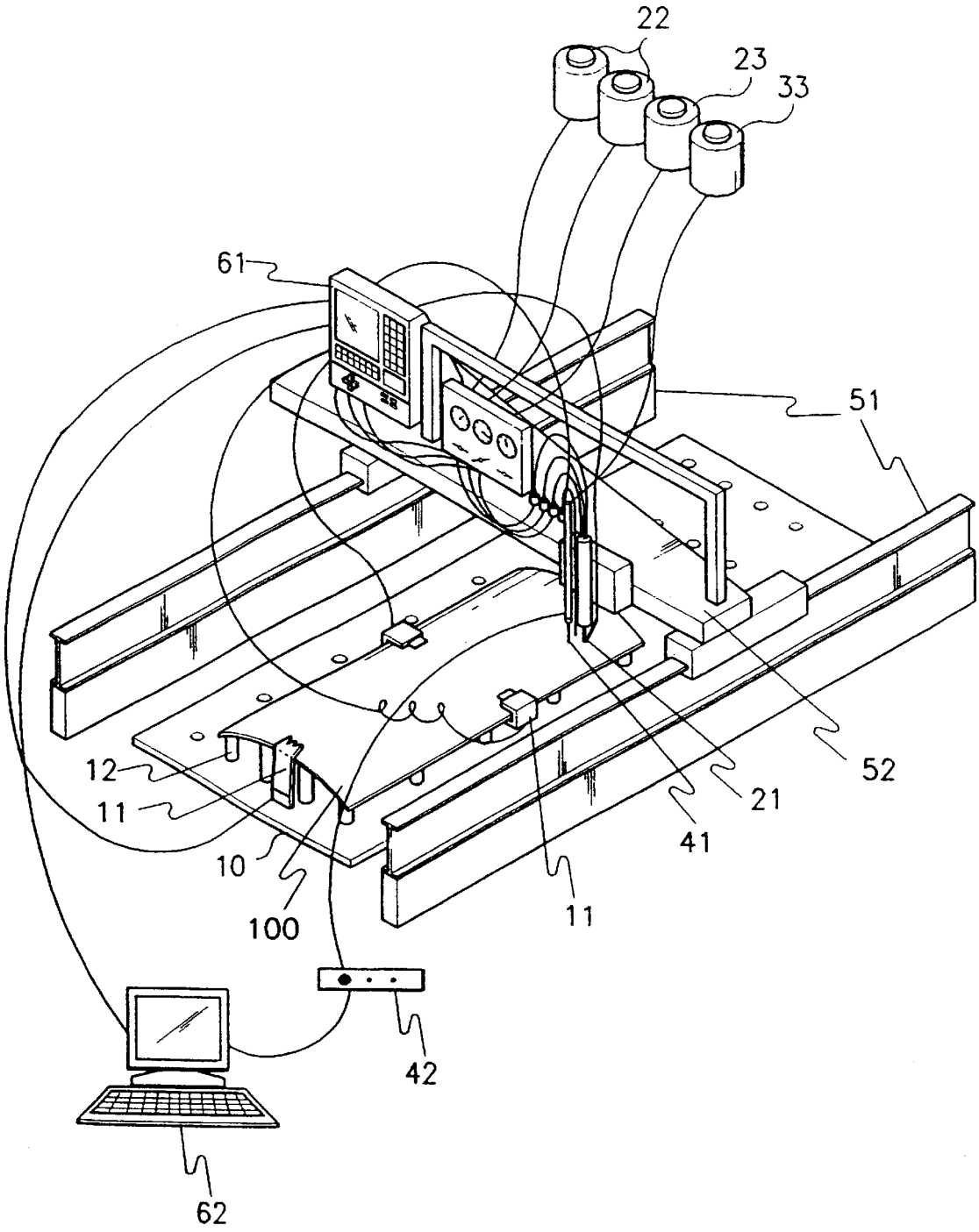
FIG. 1 is an iso-view which shows total system composition of an automatic line-heating machine for the formation of ship's curved hull-pieces in this invention.

FIG. 1 is an iso-view which shows total system composition of an automatic line-heating machine for the formation of ship's curved hull-pieces in this invention. This automatic line-heating machine consists of the followings: the heating device to heat the target plates, the cooling device to cool down the heated plates, the measuring device to acquire the data of formed plates and forming information, the driving device to move the previous devices, the control system to handle the previous devices with the main controllers and to display the operating state and the shapes of plates in process with the monitoring device, and the jig table to support the plates.

In this invention, the gas-oxygen flaming can be applied as a heating source, which consists of gas-supplying tanks (22), oxygen-supplying tanks (23), pressure controllers (24), the heating apparatus, a torch (21), and an igniter (25). Where, the pressure controllers (24) adjust the quantity of the gas and the oxygen.

The heating device should have ability to heat the steel plates up to the required temperature. For example, the heating device needs ability to heat up to 800° C. in the case of forming the thick plates which are widely used in shipbuilding.

As a heating source, laser, induction heater, the electronic beam, etc. can be substituted for the gas-oxygen flaming.

Figure 2:
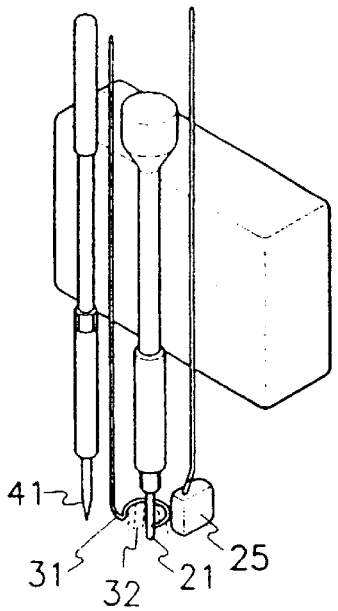
FIG. 2 is a magnified iso-view which in detail shows chief parts in this invention.
Figure 3:
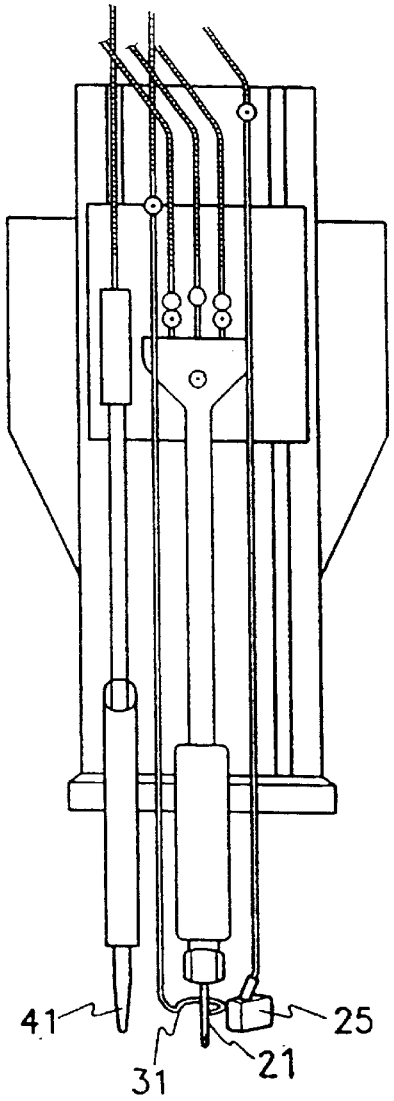
FIG. 3 is a front view which shows the internal of chief parts in this invention.
Figure 4:
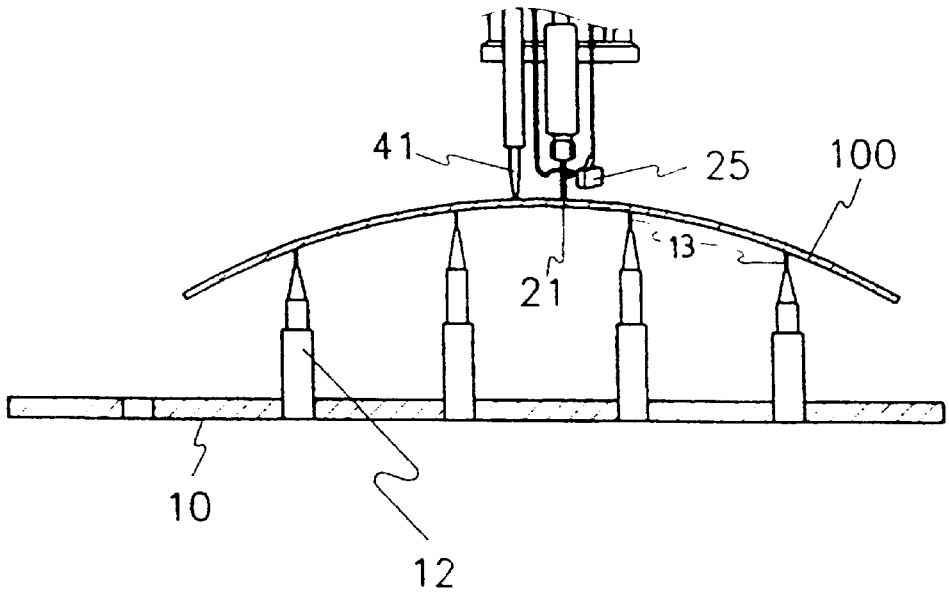
FIG. 4 isa sectional view which shows working state of our invention.

FIG. 2 in detail shows the arrangement of the heating apparatus (21), the igniter (25), the coolant pipe (31) of the cooling device and the measuring gauge (41) in this invention. FIG. 3 shows its front view. They are arranged as a single unit.

The cooling device above mentioned is installed around the heating apparatus, or torch (21) and moves along the same path with the heating apparatus (21) in order to increase the cooling and heating effect on steel plates (100). To come into effect only after heating, the cooling device has several injection nozzles (32), and it cools down the heated plate by spraying out coolant on the plates (100).

Cooling methods can be grouped into two types by the kinds of coolant: one is a water-cooling method, and the other is a air-cooling method. In a water-cooling method, a water pipe (31) is set up to surround the heating apparatus (21), and we made several injection nozzles on this rounded water pipe (31), so that the coolant, water is sprinkled around heating position.

If the air-cooling is needed, we can stop the water flow by locking the control valve that is attached on the water pipe (31). The water pipe is made to be in one body with the heat apparatus (21), so that they can move together.

The measuring device above mentioned acquires the forming state of the plates (100) and transmits the information to the control system, so that we can check the forming state through the display device of the control system.

Two types of gauges are available in the measuring devices. One is a contact type, which uses contact probes to measure, and the other is a non-contact type, which uses laser, infrared-rays, etc., instead of probes. In the previous figures, FIG. 2 and FIG. 3, the contact-type gauge (41) is illustrated. The measuring device consists of a gauge and an A/D convert. The gauge (41) measures the shape and the forming information of the plates in process and they are transmitted to the control system through A/D converter (42), which converts analog signals acquired with the gauge to digital signals. We can measure plates whenever we need new forming information, not to speak of the final state of plates.

For the driving device previously mentioned, we adopt a general driving device. It lets forming equipment that includes the heating apparatus (21) and the cooler (31) move in the transverse, longitudinal, and perpendicular direction. That is, it drives the heating apparatus (21), the cooler (31), and measuring gauge (41) of the measuring device move in accordance with commands of main controllers of the control system. It consists of transverse guide rails (51), a longitudinal guide rail (52), and some parts such as motor, chain, belt, and so on which are not illustrated in FIG. 1.

The control system above mentioned is divided into two parts—main controllers (61) and the monitoring device (62). The main controllers (61) indicate the driving device according to the forming information such as location, direction, and velocity. The monitoring device (62) shows initial information on the work plates, objective curved plates, forming information, and the processing state of formation in process through the display. By showing the processing state on the screen, based upon data measured by the measuring device, this monitoring device (62) enables workers to check the state of work process at any time. On the jig table (10) above mentioned the load-constraining apparatus (11) is installed, which prevents arbitrary deformation of the plates by uniformly distributing loads at edges of the forming plate. Several jigs (12) are located on the table in order to support the bottom of the target plates.

The jigs (12) above mentioned are the columns that are arranged on the jig table (10) and that can stretch and shrink perpendicularly. On the top of each jig the contact sensor (13) is installed. It makes possible firmly supporting an arbitrary shaped plate by adjusting the height of the jig after the control system perceiving the contact. Also it enables the control system to check the formed shape.

The work process using this invention composed of the above devices can be described as follows. First, a plate (100) is located on the jig table (10) according to the designed data of ship's hull-pieces and is fixed with the load-constraining devices (11). In accordance with the indication of the main controller (61) which the forming information is inputted into, the driving device is operated for heating, cooling, and measuring over the plate (100), when apparatuses to heat, cool, and measure come to move together automatically. In the fabrication process, the heating device makes the plate (100) deformed plastically, or permanently by locally heating the plate up to the required temperature, and the load-constraining devices (11) that supports the edges of the plates accelerates the deformation of the plate (100) by their pressing.

The jigs (12) support the bottom of plate (100), and help that the heated plates (100) are deformed. The deformation is related to the extent of jig supporting. Therefore, it is important that the jigs support the plates firmly in spite of arbitrary shapes of the plates. The contact sensor (13) that is installed on each jig (12) enables workers to immediately check whether the forming process is successfully being performed or not, by perceiving the contact between the plate (100) and jigs. The heating device is set up to heat up the plate up to about 800° C. In this device, the heat source is the mixture of propane gas and oxygen. And the temperature can be regulated through adjusting the control valves.

To maximize the heating effect and to be controlled easily, the cooling apparatus—a rounded water pipe (31) with several injection nozzles (32)—is installed around the heating apparatus, the torch. The coolant that is sprayed out from the water pipe cools the heated part of the plate.

In the measuring device, the contact type or the non-contact type can be adopted as a gauge to measure the curved plate. It enables that workers can check the shape of the plate that is either in process or in the finished. The A/D converter converts analog signals acquired with the above gauge to digital signals and these converted signals are transmitted to the control system through this converter.

Such devices as heating, cooling, and measuring are connected to the driving device and their movement is controlled automatically according to the indication of the control system.

As previously explained in detail, this invention is about a instrument that can automate formation process of ship's curved hull-pieces. This invention makes the formation process of ship's hull-pieces be systematic by using concurrently operated devices (heating, cooling, measuring devices), the driving device that drives these devices, and the control device that controls each device. In this invention, since the load is given to the plates by heating, mechanical pressing of the constraints, and jig supporting the plastic deformation can efficiently be caused to make the objective curved plates. By working on jigs, the information can be acquired faster. Since this machine uses automatic measuring device, templates do not have to be made.

This invention is a very useful technology that can make remarkable improvement of shipbuilding process by automatically forming curved plates very fast, effectively, and exactly.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An automatic machine for ship's curved hullpieces comprising:

a jig table arranged to support one or more steel plates;

a heating device including a torch to heat one side of steel plates to a required temperature and move in a horizontal/vertical direction;

a cooling device attached to the torch and arranged to cool down the heated plates by spraying out coolant from one or more nozzles;

a measuring device arranged to measure the deformed shape of steel plates with a displacement gauge to be set up beside the cooling device, and to transmit data through an A/D converter to convert analogue signals sent by the displacement gauge to digital signals;

a driving device including a transverse guide rail, a longitudinal guide rail, motors, chains, belts, all of which enable the torch, the cooling device, and the displacement gauge to move in accordance with commands; and a control system including main controllers and a display device, where main controllers issue said commands and control operations of the heating device, the cooling device, the measuring device and the driving device and where results are monitored through the display device.

2. The automatic machine according to claim 1, wherein said heating device is equipped to heat the steel plates by one of gas-oxygen flaming, laser, electric induction heating, and electronic beam heating.

3. The automatic machine according to claim 1, wherein said cooling device cools down the heated plates by one of water cooling and air cooling.

4. The automatic machine according to claim 2, wherein said heating device by the gas-oxygen flaming consists of gas-supplying tanks, oxygen-supplying tanks, pressure controllers which control the quantity of gas and oxygen, and an igniter which activates the heating of the steel plates.

5. The automatic machine according to claim 1, wherein said jig table includes a constraining device that fastens the steel plates not to move, and several jigs to have the function of the constraining device to uniformly distribute the load at edges of the plates in order to prevent undesired deformation and to support the bottom of the plates by stretching and shrinking, with each of the several jigs being equipped with a contact sensor on its end for enabling contact adjustment.

6. An automatic machine for forming a curved hull-piece of a ship, comprising:

a jig table containing a plurality of jigs arranged to support a steel plate;

a heating device arranged to move in a horizontal/vertical direction and to heat the steel plate to a predetermined temperature for forming a curved hull-piece;

a cooling device including a plurality of nozzles arranged to move along the horizontal/vertical direction of the heating device and to cool down the heated plate;

a measuring device including a gauge arranged to measure the deformed shape of the steel plate, and an A/D converter arranged to convert analogue signals from the gauge into digital signals;

a driving device including a transverse guide rail, a longitudinal guide rail, motors, chains and belts arranged to enable the heating device, the cooling device and the measuring device to move along the horizontal/vertical direction in accordance with instructions; and a control system including a main controller arranged to issue said instructions and to control operations of the heating device, the cooling device, the measuring device and the driving device to form the curved hull-piece; and a monitor device arranged to monitor formation of the curved hull-piece, including information of an initial state of the steel plate, a desired curved plate as the curved hull-piece, and processing information from the initial state of the steel plate to the desired curved plate as the curved hull-piece.

7. The automatic machine according to claim 6, wherein said heating device is equipped to heat the steel plate by one of gas-oxygen flaming, laser, electric induction heating, and electronic beam heating.

8. The automatic machine according to claim 6, wherein said cooling device cools down the heated plate by water cooling or air cooling.

9. The automatic machine according to claim 6, wherein said heating device by the gas-oxygen flaming consists of gas-supplying tanks, oxygen-supplying tanks, pressure controllers which control the quantity of gas and oxygen, and an igniter which activates the heating of the steel plate.

10. The automatic machine according to claim 6, wherein said jig table further includes a constraining device that fastens the steel plate so as not to move, and said plurality of jigs function to uniformly distribute the load at edges of the steel plate in order to prevent undesired deformation while supporting the bottom of the steel plate, each of said jigs being equipped with a contact sensor for enabling contact adjustment.

11. The automatic machine according to claim 6, wherein said heating device corresponds to a torch.

12. The automatic machine according to claim 6, wherein said cooling device corresponds to a cooling pipe.

* * * * *